US006551149B2

(12) United States Patent
Orihara

(10) Patent No.: US 6,551,149 B2
(45) Date of Patent: Apr. 22, 2003

(54) CONNECTING TERMINAL AND METHOD OF MOUNTING THE SAME ONTO A CIRCUIT BOARD

(75) Inventor: Masayuki Orihara, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/017,298

(22) Filed: Dec. 18, 2001

(65) Prior Publication Data

US 2002/0086591 A1 Jul. 4, 2002

(30) Foreign Application Priority Data

Dec. 28, 2000 (JP) ..... 2000-402843

(51) Int. Cl.[7] ..... H01R 4/48
(52) U.S. Cl. ..... 439/862; 439/83
(58) Field of Search ..... 439/862, 722, 439/66, 83, 876

(56) References Cited

U.S. PATENT DOCUMENTS 5,104,324 A * 4/1992 Grabbe et al. ..... 439/62
5,655,913 A * 8/1997 Castaneda et al. ..... 439/66
6,116,921 A * 9/2000 Scholz et al. ..... 439/83
6,296,495 B1 * 10/2001 Wang et al. ..... 439/71

* cited by examiner

*Primary Examiner*—P. Austin Bradley
*Assistant Examiner*—Alexander Gilman
(74) *Attorney, Agent, or Firm*—Armstrong, Westerman & Hattori, LLP

(57) ABSTRACT

A connecting terminal for allowing a circuit board to come into compression contact with a flat conductor with certainty, particularly to a connecting terminal having a contact part which is not irregularly deformed even if the contact part comes into compression contact with the flat conductor oblique or in the lateral direction and which maintains an optimum contact pressure. The connecting terminal is made of a substantially strip conductive plate and comprises a fixed part provided at one end of the conductive plate to be mounted onto a circuit board, and a contact part extended from the fixed part and formed by bending the conductive plate toward the fixed part to form a curved part, wherein the contact part is elastically deformed about the curved part to come into compression contact with the substantially flat conductor, and the connecting terminal further comprises a pair of side wall parts formed by bending the conductive plate 11 at the fixed part in a width direction thereof, wherein the side wall parts have a height to an extent to restrict excessive deformation of the contact part when the contact part comes into compression contact with the flat conductor. Further, an interval between the pair of side wall parts is made larger than a width of the contact part, and both end sides of the contact part contact or approach inner surfaces of the side wall parts.

6 Claims, 5 Drawing Sheets

CONNECTING TERMINAL AND METHOD OF MOUNTING THE SAME ONTO A CIRCUIT BOARD

BACKGROUND OF THE INVENTION

1. Field of the Invention

The invention relates a terminal to be connected onto a circuit board (hereinafter referred to as connecting terminal) and a method of mounting the same onto the circuit board, particularly to a connecting terminal which is effective in cases where the circuit board is grounded to another circuit board, sealing plate, a chassis, a case frame, and the like so as to prevent an electromagnetic field produced from a high frequency circuit used in a portable telephone and the like from influencing upon other devices, and a method of mounting the connecting terminal onto the circuit board.

2. Description of the Related Art

A grounding terminal has been already known since it has been disclosed, e.g., in Japanese Patent No. 3,068,557 and Japanese Utility Model Registration No. 3,064,756, wherein a grounding terminal is mounted onto a circuit board, i.e., printed circuit board and it comes into compression contact with a grounding conductor, thereby grounding the printed circuit board. FIGS. 6 and 7 show a grounding terminal as disclosed in Japanese Patent No. 3,068,557, wherein FIG. 6 is a plan view showing a state where the grounding terminal is mounted onto a printed-circuit board, and FIG. 7 is a side sectional view taken along the line A'–A' in FIG. 6. In FIG. 7, designated by 100 is a grounding terminal, 140 a contact part, 141 a restriction part, 160 a wall-like part, 161 a pawl part, 300 a printed-circuit board, 250*a*, 250*b* conductive patterns, 260 a soft solder, and 400 a grounding conductor. The grounding conductor 400 is omitted in FIG. 6.

As shown in FIG. 7, the grounding terminal 100 is formed by bending a thin strip metal member. A junction part 120 to be joined to the printed-circuit board 300 is provided on the metal member at substantially the center thereof in the longitudinal direction. The metal member is bent at the junction part 120 in the longitudinal direction so that it has a shape of mountain in cross section and a groove is formed in one surface of the junction part 120. Two junction faces 120*a*, 120*b* are formed on both sides of the mountain. The groove is formed in the junction part 120 at the portion remote from the central position thereof in the longitudinal direction by a given interval so that one junction face 120*a* is smaller than the other junction face 120*b*.

The metal member is bent at both ends of the junction part 120 in a direction opposite to the junction faces 120*a*, 120*b*. One end of the metal member which is bent at both ends of the junction part 120 is folded back at the end of the junction part 120 to form the contact part 140 and the restriction part 141. The contact part 140 comes into compression contact with the grounding conductor 400 and elastically deformed about a folded back part, namely, turnup part 130 by a given amount in a state where the grounding terminal is soldered to the printed-circuit board 300. FIG. 7 shows a state where the contact part 140 comes into compression contact with the grounding conductor 400 and is elastically deformed. A state where the contact part 140 does not come into contact with a grounding conductor 400 is illustrated by two-dotted one chain line. The contact part 140 comes into compression contact with the grounding conductor 400 by a repulsive force caused by the elastic deformation thereof and becomes conductive to the grounding conductor 400 so that the printed-circuit board 300 is grounded to the grounding conductor 400.

With the construction of the grounding terminal 100, the restriction part 141 is formed on the grounding terminal 100 while continuously connecting to the contact part 140 of the grounding terminal 100 so that the contact part 140 does not exceed an elastic limit when the contact part 140 is elastically deformed. The restriction part 141 comes into contact with the opposite side of the junction face of the junction part 120 at its tip end when the contact part 140 is elastically deformed by a given amount so that the amount of elastic deformation of the contact part 140 is restricted.

With the grounding terminal having such a construction, since the tip end of the restriction part 141 comes into contact with the opposite side of the junction part 120 every time the contact part 140 comes into compression contact with the grounding conductor 400, there arises a possibility that the opposite side of the junction part 120 with which the restriction part 141 comes into contact is injured to induce inferior connection at the junction part 120. Further, since the tip end of the restriction part 141 comes into contact with the opposite side of the junction face when the contact part 140 comes into compression contact with the grounding conductor 400, the moving range of the contact part 140 is restricted, thereby making it difficult to obtain a repulsive force owing to the elastic deformation of the contact part 140, namely, to obtain a given contact pressure between the grounding conductor 400 and the contact part 140.

There occurs a so-called wicking phenomenon where solder is sucked up to the portion close to the turnup part 130 about which the contact part 140 is elastically deformed so that solder is stuck to the portion close to the turnup part 130, thereby impeding the elastic deformation of the contact part 140 to induce the deterioration of spring performance. To cope with such a deterioration of spring performance, the turnup part 130 about which the contact part 140 is elastically deformed is formed at a position remote from the junction part 120 having a small junction area by a given interval. As a result, a solder 260*a* supplied to the junction face 120*a* having a small junction area is not sucked up to the turnup part 130 of the contact part 140, thereby preventing the solder 260*a* from sticking to the turnup part 130. Since the turnup part 130 is formed at the position remote from the small junction face 120*a* having a small junction area by a given interval, the contact part 140 is to be formed in a specific shape, causing a problem in the formation of the contact part 140. Further, since the solder 260*a* is stuck to the portion close to the turnup part 130, a peeling force is applied to the solder fixed part every time the contact part 140 is elastically deformed. If the contact part 140 is repeatedly elastically deformed, the solder fixed part is peeled off and cracked, thereby making it difficult to maintain the conduction.

FIG. 8 shows a grounding terminal disclosed in Japanese Utility Model Registration No. 3,064,756. The grounding terminal comprises a substrate part which is mounted on a grounding pattern of a printed-circuit board 350, a spring contact 311 which is protruded integrally from one side of the substrate part to a side confronting the substrate part, and an engaging wall 360 integrally standing upright on the substrate part and engaging with the tip end of the spring contact 311. Since the grounding terminal has the engaging wall 360 engaging with the tip end of the spring contact 311, the engaging wall 360 functions as a stopper relative to an irregular external force which is produced when fingers and the like strike against the spring contact 311, thereby restraining the deformation of the grounding terminal. As a result, it is possible to eliminate such drawbacks that inferior contact is made between the deformed spring contact 311 and a chassis and the like and a storing operation is obstructed which occurred when the spring contact 311 is caught by the chassis when the substrate is stored in the chassis.

However, in cases where the grounding terminal comes into compression contact with a sealed panel and the like from the above when the grounding terminal contacts the sealed panel and the like, the spring contact 311 is not irregularly deformed. However, when the sealed panel and the like is pressed down or compressed oblique or in the lateral direction, which is caused by the deviation of the sealed panel, the spring contact 311 is crushed in the lateral direction and is irregularly deformed, so that there arises a possibility that an elastic force as designed cannot be maintained. Further, the grounding terminal is designed such that the portion where the spring contact 311 actually contacts the sealed panel and the like has an allowable width in a movable (swingable) range of the spring contact 311 at a position higher than the tip end of the engaging wall even if the grounding terminal is rendered in a state where it contacts the sealed panel and the like in the same manner as rendered in a state where it does not contact the sealed panel and the like. However, when the spring contact 311 having such a construction is excessively pressed down by a sealed panel and the like, the tip end of the contact comes into contact with the substrate part, and hence the movable range is limited, making it difficult to keep an optimum elastic force.

SUMMARY OF THE INVENTION

Accordingly, it is an object of the invention to solve the problems of the conventional grounding terminal and provide a connecting terminal for allowing a circuit board to come into compression contact with a flat conductor with certainty, particularly to a connecting terminal in which a contact part will not irregularly deformed even if it is pressed down oblique or in the lateral direction, thereby maintaining an optimum contact pressure.

It is another object of the invention to provide a method of mounting the connecting terminal onto a circuit board capable of preventing solder from sticking to a portion close to a curved part owing to a wicking phenomenon where solder is sucked up to the portion close to the curved part about which the contact part is elastically deformed when the connecting terminal is mounted onto the circuit board by soldering, so that the contact part maintains a contact pressure as designed.

To achieve the above objects, the connecting terminal according to a first aspect of the invention is made of a substantially strip conductive plate and comprises a fixed part provided at one end of the conductive plate to be mounted onto a circuit board, and a contact part extended from the fixed part and formed by bending the conductive plate toward the fixed part to form a curved part, said contact part being elastically deformed about the curved part to come into compression contact with a substantially flat conductor, wherein the connecting terminal is characterized in further comprising a pair of side wall parts formed by bending the conductive plate at the fixed part in a width direction thereof, said side wall parts having a height to an extent to restrict excessive deformation of the contact part when the contact part comes into compression contact with the flat conductor. With such a construction, if the connecting terminal comes into compression contact with the flat conductor, an excellent contact is maintained between the contact part and the flat conductor. Further, even if an excessive compression force is applied to the contact part, the flat conductor is restricted by the side wall parts, thereby preventing permanent deformation of the contact part.

The connecting terminal of the invention is characterized in that an interval between the side wall parts is made larger than a width of the contact part, and both end sides of the contact part contact or approach inner side walls of the side wall parts when the contact part comes into compression contact with the flat conductor. With such a construction, the connecting terminal can allow the circuit board to come into compression contact with the flat conductor with certainty. Particularly, even if the contact part comes into compression contact with the flat conductor oblique or in the lateral direction, the contact part will not irregularly deformed so that an optimum contact pressure can be maintained.

The connecting terminal of the invention is characterized in further comprising projection pieces provided on the conductive plate in the width direction close to the curved part between the fixed part and the curved part. If the connecting terminal is mounted onto the circuit board, the projection pieces come into contact with the circuit board, thereby realizing stable mounting.

A connecting terminal according to a second aspect of the invention is made of a substantially strip conductive plate and comprises a fixed part provided at one end of the conductive plate to be mounted onto a circuit board, and a contact part extended from the fixed part and formed by bending the conductive plate toward the fixed part to form a curved part, said contact part being elastically deformed about the curved part to come into compression contact with a substantially flat conductor, wherein the connecting terminal is characterized in further comprising a notch defined and separating between the fixed part and the curved part, said fixed part and the separated part being connected to each other by a pair of side wall parts formed by bending the conductive plate in the width direction thereof toward the contact part.

The connecting terminal of the invention is characterized in that a plurality of notches are defined in the fixed part for cutting off the fixed part into a plurality of fixed parts and separated part, said fixed parts and the separated part being connected to each other by a pair of side wall parts formed by bending the fixed part in the width direction thereof toward the contact part.

Further, the connecting terminal of the invention is characterized in that the side wall parts have a height to an extent to restrict excessive deformation of the contact part when the contact part comes into compression contact with the flat conductor. With such a construction, if the connecting terminal comes into compression contact with the flat conductor, an excellent contact is maintained between the contact part and the flat conductor, and further, even if an excessive compression force is applied to the contact part, the flat conductor is restricted by the side wall parts, thereby preventing permanent deformation of the contact part.

The connecting terminal of the invention is characterized in that the interval between the side wall parts is larger than a width of the contact part, and both end sides of the contact part contact or approach inner surfaces of the side wall parts when the contact part comes into compression contact with the flat conductor. With such a construction, even if the contact part comes into compression contact with the flat conductor oblique or in the lateral direction, the contact part will not irregularly deformed, thereby maintaining an optimum contact pressure.

Further, the connecting terminal of the invention is characterized in further comprising projection pieces provided on the conductive plate in the width direction close to the curved part between the fixed part and the curved part.

Still further, the method of mounting a connecting terminal onto a conductor of a circuit board according to the invention is characterized in comprising preparing a connecting terminal used in the second aspect of the invention and fixing bottom surfaces of a plurality of separated fixed parts to the conductor of the circuit board by soldering except the separated part close to a curved part of the plurality of separated fixed parts. With such a construction, the connecting terminal is fixed between the fixed parts and the conductive pattern by soldering but it is not fixed at the separated part close to the curved part by soldering. Accordingly, there does not occur a case where solder at the fixed part is sucked up to a curved part owing to a wicking phenomenon when the connecting terminal is mounted onto the circuit board so that spring performance is not changed, and contact pressure of the contact part relative to the counterpart, i.e., flat conductor can be maintained at numerical values substantially the same as designed. Further, since the solder is not stuck to the curved part, it is possible to completely avoid a drawback of the occurrence of the crack owing to the sticking of the solder onto the curved part which has been made in the prior art.

PREFERRED EMBODIMENT OF THE INVENTION

Figure 1:
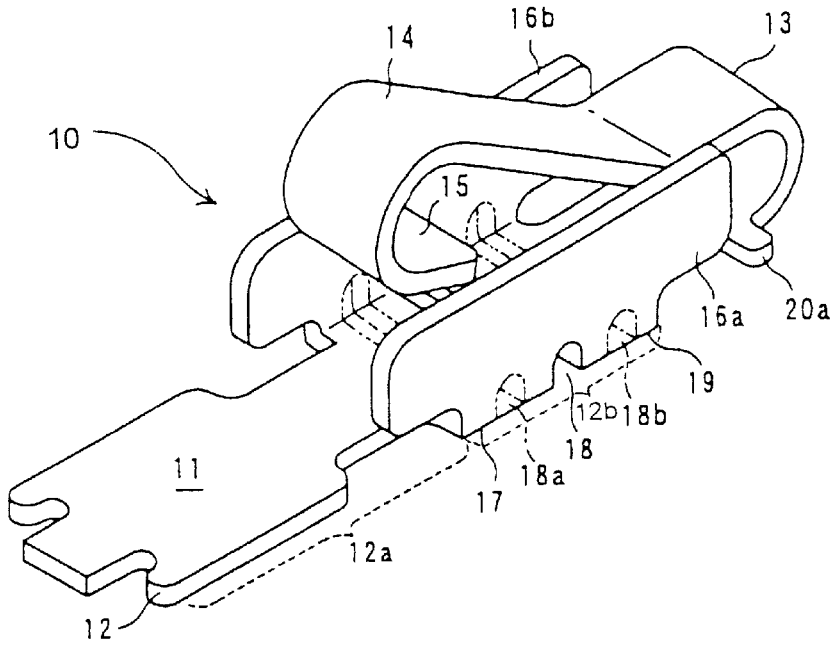
FIG. 1 is a perspective view showing the entire connecting terminal according to a preferred embodiment of the invention.
Figure 2:
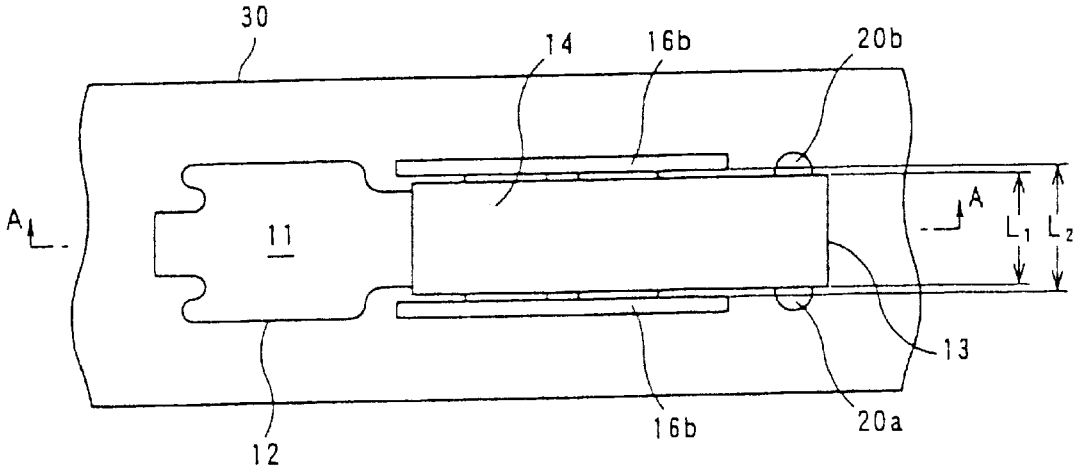
FIG. 2 is a plan view showing a state where the connecting terminal is mounted onto a circuit board according to the preferred embodiment of the invention.
Figure 3:
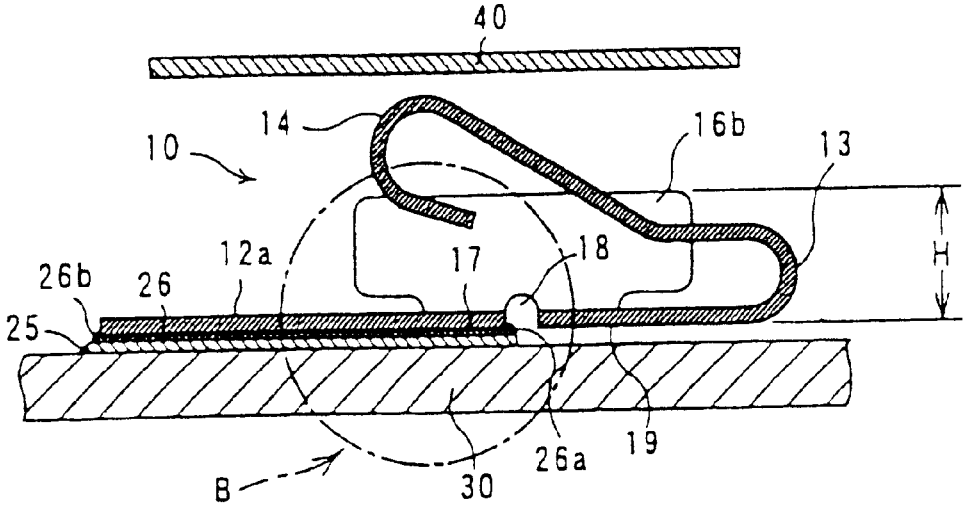
FIG. 3 is a side sectional view taken along the line A—A in FIG. 2.

A preferred embodiment of a connecting terminal which embodies the invention is described with reference to the attached drawings. A connecting terminal according to the preferred embodiment and a state where the connecting terminal is mounted onto a circuit board are illustrated in FIGS. 1 to 3. FIG. 1 is a perspective view showing the entire connecting terminal according to the preferred embodiment of the invention, FIG. 2 is a plan view showing a state where the connecting terminal is mounted onto the circuit board according to the preferred embodiment of the invention, and FIG. 3 is a side sectional view taken along the line A—A in FIG. 2. The flat conductor 40 is omitted in FIG. 2.

As shown in FIG. 1, a connecting terminal 10 according to the preferred embodiment is made of a conductive plate 11 having substantially a strip shape prepared by punching a conductive metal plate. The connecting terminal 10 is made of a conductive plate 11 and comprises a fixed part 12 which is provided at one end of the conductive plate 11 to be mounted onto a circuit board 30 and a contact part 14 which is extended from the fixed part 12 and bent back toward the fixed part 12, and a pair of side wall parts 16*a*, 16*b* formed by bending the conductive plate 11 at both sides of the fixed part 12 in a width direction thereof toward the contact part 14.

The conductive plate 11 has determined width, thickness and length, and is formed of metal having an excellent conduction. A surface treatment is applied to the surface of the metal, if need be. Although the dimensions, i.e., width, thickness and length of the conductive plate 11 are determined to arbitrary ones depending on the purpose of the terminal, for example, if the connecting terminal is used for a grounding terminal of a portable telephone, the dimensions thereof are determined to a millimeter unit.

The fixed part 12 is a part which is fixed to a conductive pattern of the circuit board by soldering, described later, and a notch 18 is defined in the fixed part 12*b* substantially at the center thereof to separate between the fixed part 12 and the curved part 13. Although one notch 18 is defined in the fixed part 12*b* in FIG. 1, a plurality of notches 18*a*, 18*b* may be defined in the fixed part 12*b* in predetermined intervals as shown in dotted lines in FIG. 1 so as to cut off the fixed part 12*b* into a plurality of fixed parts and a separated part. Although the shape of each of the notches 18, 18*a*, 18*b* is substantially semicircular, it is not limited to such a semicircular shape but may be in an arbitrary shape such as an inverted V shape or an inverted U shape. Further, although the notch 18 is defined in the portion close to substantially the center of the fixed part 12*b*, it is not limited to the substantially center but may be biased toward the curved part 13.

Projection pieces 20*a*, 20*b* are provided on both sides of the conductive plate 11 in the width direction in the vicinity of the curved part 13 between the fixed part 12*b* and the curved part 13, as occasion demands. The projection pieces 20*a*, 20*b* come into contact with a face of the circuit board when the connecting terminal 10 is fixed to the circuit board, thereby serving stability of the connecting terminal 10.

The contact part 14 is extended from the fixed part 12 and formed by bending the conductive plate 11 midway toward the fixed part 12, and it is elastically deformed at the curved part 13, so that spring performance is applied to the contact part 14. Further, the portion where the contact part 14 contacts a substantially flat conductor, described later, is formed in a shape to attain a surface or line contact between the contact part 14 and the flat conductor. The tip end of the contact part 14 may be curved to an opposite side, if need be, so that it may not directly contact the fixed part 12.

The pair of side wall parts 16*a*, 16*b* are formed by bending the conductive plate 11 to stand upright at both sides of the fixed part 12*b* toward the contact part 14. Although the side wall parts 16*a*, 16*b* are formed in an arbitrary shape depending on the length of the connecting terminal, it is preferable that the side wall parts 16*a*, 16*b* are formed of substantially long side walls. When the notch 18 is defined in the fixed part 12*b* as set forth above, the fixed part 12 and the curved part 13 are separated from each other, so that they are connected to each other by the pair of side wall parts 16*a*, 16*b*. An interval $L_2$ between the side wall parts 16*a*, 16*b* is slightly larger than a width interval $L_1$ of the conductive plate 11 forming the contact part 14 so that the width of the contact part 14 is determined to an extent to contact or approach the inner surfaces of the side wall parts 16*a*, 16*b* (see FIG. 2). Accordingly, when the contact part 14 comes into compression contact with the flat conductor 40, end side surfaces of the contact part 14 in the width direction slide on the inner wall surfaces of the side wall parts 16*a*, 16*b*, so that the side wall parts 16*a*, 16*b* serve as a guide of the contact part 14. Even if the contact part 14 comes into compression contact with the flat conductor 40 oblique or in the lateral direction, the pair of side wall parts 16*a*, 16*b* serve to adjust the orbit of the contact part 14.

The height H of the side wall parts 16*a*, 16*b* is set that when the contact part 14 is pressed down by the flat conductor 40, the tip end of the contact part 14 does not come into contact with the surface of the fixed part 12, or even if the tip end of the contact part 14 comes into contact with the surface of the fixed part 12, it does not strongly come into contact with the fixed part 12, or set that the contact part 14 can maintain a given contact pressure in a state where the contact part 14 which is deformed about the curved part 13 comes into contact with the flat conductor 40 (see FIG. 3). Since the side wall parts 16*a*, 16*b* have such a height H, even if the contact part 14 is pressed down by the flat conductor stronger than in a normal state, the pair of side wall parts 16*a*, 16*b* serve as a stopper so that the contact part 14 is not excessively deformed about the curved part 13 to be permanently deformed, so that the contact part 14 can maintain a contact pressure as designed.

FIG. 2 is a plan view showing a state where the connecting terminal 10 in FIG. 1 is mounted onto a circuit board 30. If the connecting terminal 10 is used, e.g., for a grounding terminal of a portable telephone, a high frequency oscillation circuit and the like for use in the portable telephone are mounted on the circuit board 30. The connecting terminal 10 is mounted onto the circuit board 30 by soldering and the like. The flat conductor 40 is omitted in FIG. 2. FIG. 3 is a side sectional view taken along the line A—A in FIG. 2. The flat conductor 40 is substantially a flat conductor to be connected to a conductor pattern 25 of the circuit board 30 by way of the connecting terminal 10, and it is formed of other circuit boards, a chassis and a case frame and the like. The conductor pattern 25 is printed on the circuit board 30. Designated by 26 is a soft solder.

Figure 4:
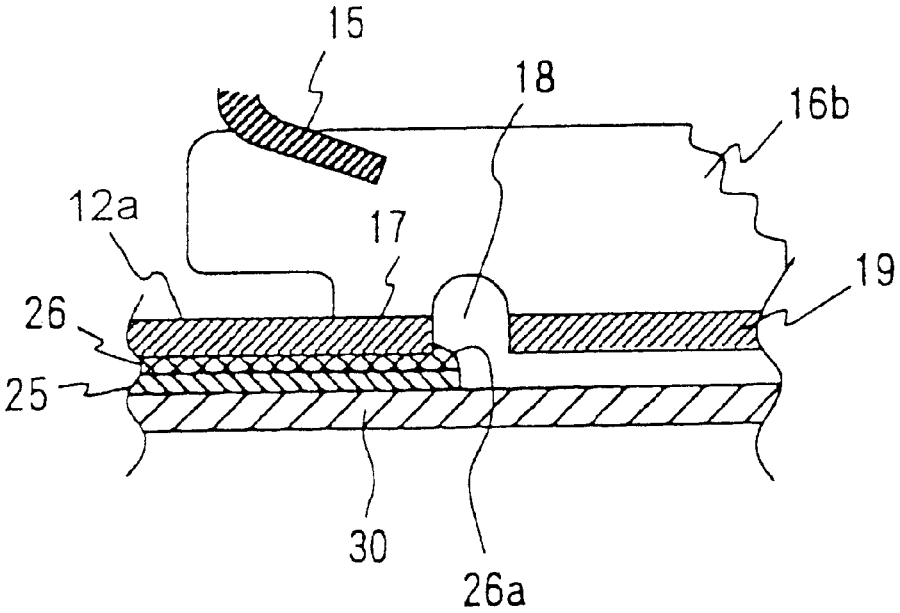
FIG. 4 is an enlarged view of a part B as depicted by one-dotted chain line in FIG. 3.

A method of mounting the connecting terminal 10 onto the circuit board 30 is described with reference to FIGS. 3 and 4. FIG. 4 is an enlarged view of a part B depicted by one dotted-chain line in FIG. 3.

If one notch 18 is defined in the connecting terminal 10, two fixed parts 12*a*, 17 is fixed to the conductor pattern 25 formed on the circuit board 30 by soldering and one part 19 free from soldering. A method of mounting the fixed part 17 onto the conductor pattern 25 of the circuit board 30 comprises supplying soft solder 26 in advance to the conductor pattern 25 corresponding to the fixed parts 12*a* and 17 by a well known metal mask. It is important here that the separated part 19 is not fixed to the conductor pattern 25 by soldering. Subsequently, the fixed part 17 is temporarily fixed to the circuit board 30 utilizing viscosity of the soft solder 26, and the temporarily fixed circuit board 30 is heated in a reflow bath so that the soft solder 26 is melted for soldering between the fixed part 17 and the circuit board 30. Since the reflow soldering treatment is well known, the explanation thereof is omitted.

In cases where two notches 18*a*, 18*b* or three notches 18, 18*a*, 18*b* are defined in the fixed part 12*b* instead of one notch, the soft solder 26 is supplied to the conductor pattern 25 in the direction from the fixed part 12*a* to the fixed part 17 but not supplied to a separated part 19 which is formed by cutting off the fixed part 12*b* at the portion close to the curved part 13 between the fixed part 17 and the curved part 13. Accordingly, the fixation between the cut off separated part close to the curved part 13 and the conductor pattern 25 is not effected by soldering.

Figure 5:
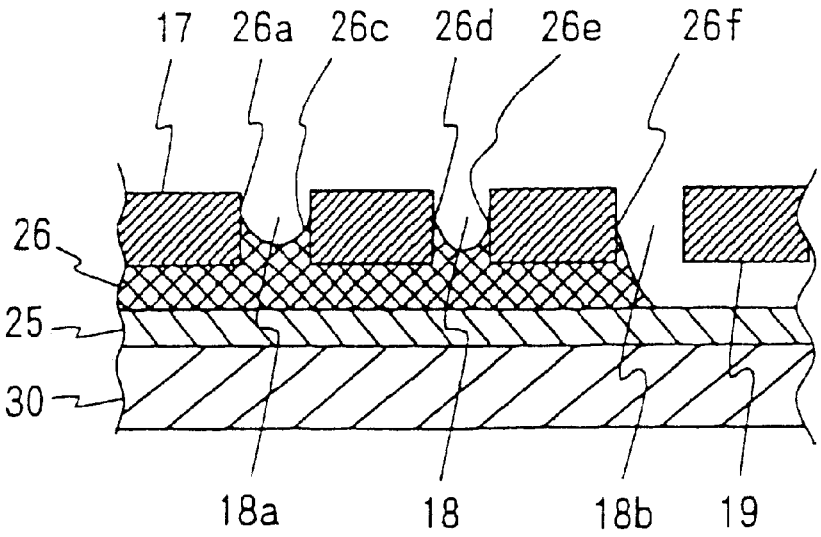
FIG. 5 is an enlarged view of the part B as depicted by one-dotted chain line in FIG. 3 according to another embodiment of the invention.
Figure 6:
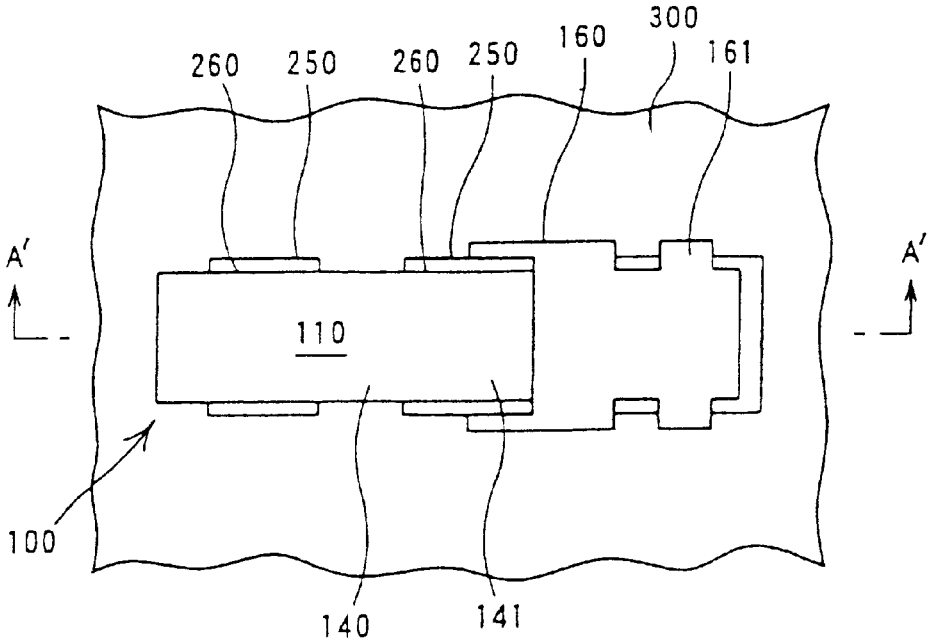
FIG. 6(PRIOR ART)
FIG. 6 is a plan view showing a state where a conventional grounding terminal is mounted onto a printed-circuit board.
Figure 7:
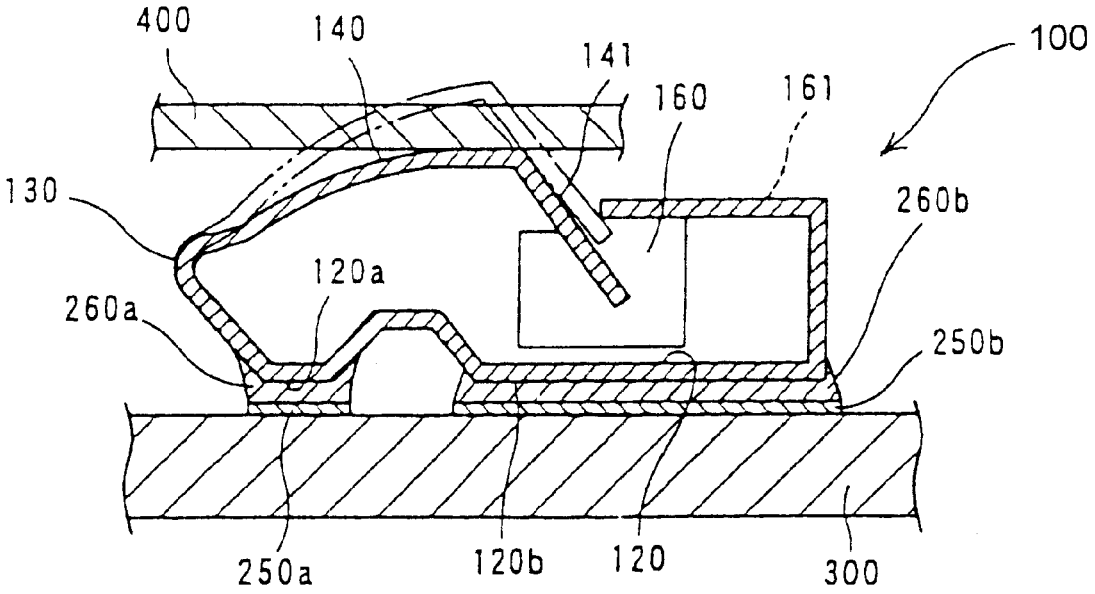
FIG. 7 (PRIOR ART)
FIG. 7 is a side sectional view taken along the line A'–A' in FIG. 6.
Figure 8A:
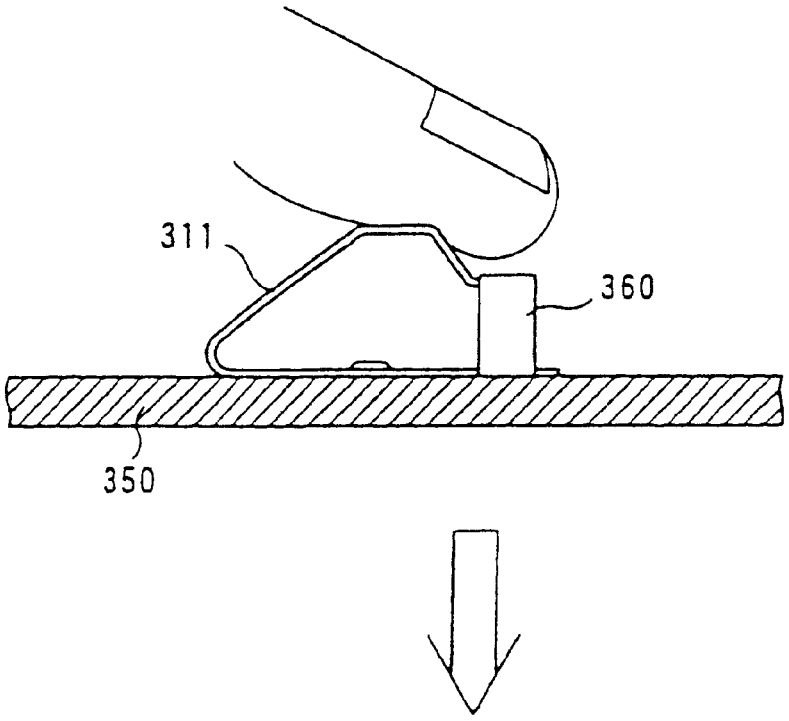
FIG. 8(A) (PRIOR ART)
FIG. 8 is a sectional view showing a state of use of another conventional grounding terminal, wherein FIG. 8 (A) shows the state where a spring contact is intended to engage with an engaging wall, and FIG. 8 (B) shows the state where the spring contact is engaged with the engaging wall.
Figure 8B:
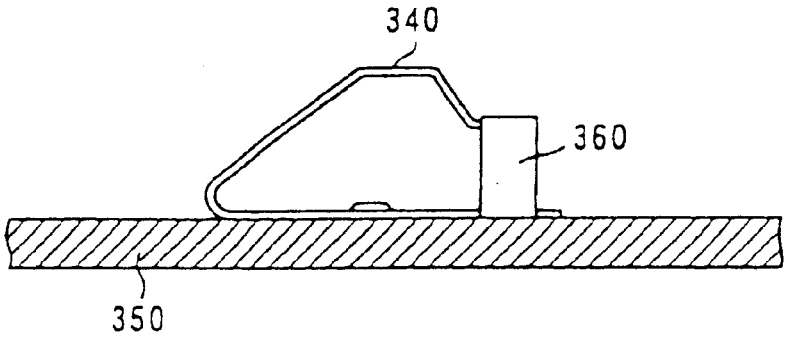
FIG. 8(B) (PRIOR ART)

When a soldering treatment is effected, the soft solder 26 supplied to both the fixed parts 12*a*, 17, and the conductor pattern 25 is heated and molten and flows to the periphery of each fixed part, but the flow of the soft solder 26 is stopped by the notch 18 because the soft solder 26 which flows in the longitudinal direction of the fixed part 17 is separated by the notch 18, thereby preventing the soft solder 26 from flowing at least to the separated part 19 and the curved part 13. Accordingly, the fixed parts 12*a*, 17 are fixed to the conductor pattern 25 by the soft solder 26 so as to form solder fillets 26*a*, 26*b* at both ends of the fixed parts 12*a*, 17 so that the fixed parts 12*a*, 17 are firmly fixed to the conductor pattern 25. Although the soft solder 26 is supplied to the entire surfaces of spots on the conductor pattern 25 corresponding to the fixed part 12*a*, 17, but it may be supplied separately to several spots, e.g., the center and both ends of the fixed part 17. FIG. 5 is an enlarged view of apart B depicted by one dotted chain line in FIG. 3 and shows a method of mounting the connecting terminal wherein the fixed part 12*b* has a plurality of notches, and solder fillets 26*a*, 26*c*, 26*d* to 26*f* are formed on both ends of three notches 18*a*, 18, 18*b*. Since the number of spots where the solder fillets are formed for increasing a fixing force relative to the circuit board can be increased by defining a plurality of notches in the fixed part 12*b* so that the fixing force can be increased compared with a case where one notch is defined in the fixed part 12*b*.

With the method of mounting the connecting terminal onto the circuit board, the connecting terminal 10 is fixed between the fixed parts 12*a*, 17 and the conductor pattern 25 by soldering, but it is not soldered to the separated part 19 close to the curved part 13 by soldering. Accordingly, there does not occur a case where the soft solder 26 at the fixed part 12 is sucked up to the curved part 13 owing to a wicking phenomenon, thereby changing spring performance when the connecting terminal 10 is mounted onto the circuit board 30, so that the compression force of the contact part 14 relative to the counter part, i.e., flat conductor 40 is maintained at values as designed. At the same time, since the solder is not stuck to the curved part 13, it is possible to completely avoid a problem of production of cracks which has occurred in the prior art connecting terminal when the solder is stuck to the curved part.

Further, if the connecting terminal 10 comes into compression contact with the flat conductor 40 in this mounting state, excellent contact is maintained between the contact part 14 and flat conductor 40, while even if an excessive compression force is applied to the connecting terminal 10, the connecting terminal 10 is restricted by the side walls 16*a*, 16*b* at the side of the flat conductor 40 so that permanent deformation of the contact part 14 is prevented.

Although the connecting terminal and the method of mounting the same onto the circuit board have been described with reference to the preferred embodiment of the invention, the invention is not limited to the preferred embodiment in any way, and can be worked in various embodiments without departing from the sprit of the invention. For example, in cases where the connecting terminal is required only for preventing the excessive deformation of the contact part 14, the notch 18 for separating between the curved part 13 and the fixed part 12 is not indispensable while in cases where the connecting terminal is required only for preventing solder from sticking to the portion close to the curved part, a pair of side wall parts are not always necessary.

According to the connecting terminal of the invention, the circuit board come into compression contact with the flat conductor with certainty. Particularly, even if the contact part comes into compression contact with the flat conductor oblique or in the lateral direction, the contact part is not irregularly deformed so that an optimum contact pressure can be maintained.

Still further, it is possible to prevent solder from sticking to the portion close to the curved part owing to a wicking phenomenon where the solder is sucked up to the curved part about which the contact part is elastically deformed by the notch for separating between the curved part and the fixed part when the connecting terminal of the invention is mounted onto the circuit board by soldering, so that the contact part can maintain a contact pressure as designed. Further, if a plurality of notches are defined so as to increase the number of portions where solder fillets are formed so as to increase a fixing force relative to the circuit board, the fixing force can be increased compared with a case where one notch is defined for separating between the curved part and the fixed parts.

What is claimed is:

1. A connecting terminal made of a substantially strip conductive plate and comprising a fixed part provided at one end of the conductive plate to be mounted onto a circuit board, and a contact part at the other end of the conductive plate formed by bending the conductive plate toward the fixed part to form a curved part, said contact part being elastically deformed about the curved part to come into compression contact with a substantially flat conductor, said connecting terminal further comprising a pair of side wall parts formed by bending the conductive plate in the width direction thereof toward the contact part, wherein the interval between the side wall parts is made larger than a width of the contact part, and both end sides of the contact part contact or approach inner surfaces of the side wall parts when the contact part comes into compression contact with the flat conductor, and a notch defined at the base of the side wall parts forming a slot on the base plate thereof to separate a separated part from the fixed part, said separated part connected to the fixed part by the pair of side wall parts.

2. The connecting terminal according to claim 1, said connecting terminal further comprising projection pieces provided on the conductive plate extending beyond the edges of the conductive plate in the width direction of the connecting terminal close to the curved part between the fixed part and the curved part.

3. The connecting terminal according to claim 1, wherein a plurality of notches are defined in the fixed part for cutting off said fixed part into a plurality of fixed parts and a separated part, said fixed parts and separated part being connected to each other by a pair of side wall parts formed by bending the fixed part in the width direction thereof toward the contact part.

4. A method of mounting a connecting terminal onto a conductor of a circuit board comprising preparing a connecting terminal used in claim 3 and fixing bottom surfaces of a plurality of separated fixed parts to the conductor of the circuit board by soldering except the separated part close to a curved part.

5. A method of mounting a connecting terminal onto a conductor of a circuit board comprising preparing a connecting terminal used in claim 1 and fixing a bottom surface of said separated fixed part to the conductor of the circuit board by soldering except the separated part close to a curved part.

6. The connecting terminal according to claim 1 or 3, wherein the sidewall parts have a height to an extent to restrict excessive deformation of the contact part when the contact part comes into compression contact with the flat conductor.

* * * * *